US007997999B2

(12) United States Patent
Roach et al.

(10) Patent No.: US 7,997,999 B2
(45) **Date of Patent: *Aug. 16, 2011**

(54) MULTI-PIECE GOLF CLUB HEAD WITH IMPROVED INERTIA

(75) Inventors: Ryan L. Roach, Carlsbad, CA (US); Peter L. Soracco, Carlsbad, CA (US); Christopher B. Best, Park City, UT (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/553,977

(22) Filed: Sep. 3, 2009

(65) Prior Publication Data

US 2010/0056297 A1 Mar. 4, 2010

Related U.S. Application Data

(63) Continuation-in-part of application No. 11/808,189, filed on Jun. 7, 2007, now Pat. No. 7,588,503, which is a continuation-in-part of application No. 11/064,965, filed on Feb. 25, 2005, now Pat. No. 7,244,188, and a continuation-in-part of application No. 11/266,180, filed on Nov. 4, 2005, which is a continuation-in-part of application No. 10/843,622, filed on May 12, 2004, now Pat. No. 7,481,718.

(51) Int. Cl.
*A63B 53/04* (2006.01)

(52) U.S. Cl. ..... 473/332; 473/349; 473/350

(58) Field of Classification Search ..... 473/332, 473/334–337, 290–291, 349–350
See application file for complete search history.

(56) References Cited

U.S. PATENT DOCUMENTS

| | | | | |
|---|---|---|---|---|
| 1,319,233 | A * | 10/1919 | Mattern | 473/337 |
| 1,534,600 | A * | 4/1925 | Mattern | 473/337 |
| 2,429,351 | A | 10/1947 | Fetterolf | |
| 3,084,940 | A | 4/1963 | Cissel | |

(Continued)

FOREIGN PATENT DOCUMENTS

| | | |
|---|---|---|
| JP | 05-168732 | 7/1993 |

(Continued)

OTHER PUBLICATIONS

Japanese Office Action dated Aug. 2, 2010 of corresponding Japanese Patent Application No. 2006-300589.

(Continued)

*Primary Examiner* — Stephen L. Blau
(74) *Attorney, Agent, or Firm* — Knobbe Martens Olson & Bear, LLP

(57) ABSTRACT

A multi-piece iron-type golf club head with a substantial weight member is disclosed and claimed. The golf club head includes a plurality of body members. A first body member includes a face, a rear surface, and a hosel. A viscoelastic material is attached to the rear surface, and a second body member is attached to the viscoelastic material. The second body member, which may be a weight member, has a substantially larger mass than in known golf clubs. The viscoelastic member may form a substantial part of the club head. The club head may also have a recess located in a top portion thereof between the heel and the toe and extending toward the sole. A low-density insert may be positioned within the recess.

3 Claims, 11 Drawing Sheets

U.S. PATENT DOCUMENTS

| | | | | | |
|---|---|---|---|---|---|
| 3,881,733 | A | | 5/1975 | Csernits | |
| 3,970,236 | A | | 7/1976 | Rogers | |
| 4,027,885 | A | | 6/1977 | Rogers | |
| 4,340,230 | A | | 7/1982 | Churchward | |
| 4,398,965 | A | | 8/1983 | Campau | |
| 4,523,759 | A | | 6/1985 | Igarashi | |
| 4,607,846 | A | | 8/1986 | Perkins | |
| 4,687,205 | A | * | 8/1987 | Tominaga et al. | 473/348 |
| 4,811,950 | A | * | 3/1989 | Kobayashi | 473/335 |
| 4,874,171 | A | | 10/1989 | Ezaki et al. | |
| 4,928,972 | A | | 5/1990 | Nakanishi et al. | |
| 4,957,294 | A | * | 9/1990 | Long | 473/350 |
| D321,920 | S | | 11/1991 | Parente et al. | |
| 5,110,131 | A | * | 5/1992 | Long | 473/349 |
| 5,221,087 | A | | 6/1993 | Fenton et al. | |
| D339,183 | S | | 9/1993 | Stites, III | |
| D343,216 | S | | 1/1994 | Chorne | |
| 5,303,922 | A | | 4/1994 | Lo | |
| 5,316,298 | A | | 5/1994 | Hutin et al. | |
| 5,377,979 | A | | 1/1995 | Long | |
| 5,377,985 | A | | 1/1995 | Ohnishi | |
| 5,413,336 | A | * | 5/1995 | Iwanaga | 473/291 |
| 5,439,223 | A | * | 8/1995 | Kobayashi | 473/334 |
| 5,492,327 | A | | 2/1996 | Biafore, Jr. | |
| 5,544,885 | A | | 8/1996 | Besnard et al. | |
| 5,564,705 | A | | 10/1996 | Kobayashi et al. | |
| 5,586,947 | A | | 12/1996 | Hutin | |
| 5,616,088 | A | | 4/1997 | Aizawa et al. | |
| 5,643,112 | A | | 7/1997 | Besnard et al. | |
| 5,669,826 | A | | 9/1997 | Chang et al. | |
| 5,772,527 | A | | 6/1998 | Liu | |
| 5,938,540 | A | * | 8/1999 | Lu | 473/288 |
| 6,042,486 | A | | 3/2000 | Gallagher | |
| 6,080,069 | A | | 6/2000 | Long | |
| 6,093,112 | A | | 7/2000 | Peters et al. | |
| RE36,950 | E | | 11/2000 | Allen | |
| 6,302,807 | B1 | | 10/2001 | Rohrer | |
| 6,306,048 | B1 | | 10/2001 | McCabe et al. | |
| 6,332,848 | B1 | * | 12/2001 | Long et al. | 473/328 |
| 6,443,857 | B1 | | 9/2002 | Chuang | |
| 6,478,690 | B2 | * | 11/2002 | Helmstetter et al. | 473/324 |
| 6,592,469 | B2 | | 7/2003 | Gilbert | |
| 6,688,989 | B2 | | 2/2004 | Best | |
| 6,702,693 | B2 | | 3/2004 | Bamber | |
| 6,769,998 | B2 | | 8/2004 | Clausen et al. | |
| 6,773,361 | B1 | | 8/2004 | Lee | |
| 6,814,674 | B2 | * | 11/2004 | Clausen et al. | 473/342 |
| 6,830,519 | B2 | * | 12/2004 | Reed et al. | 473/290 |
| 6,902,495 | B2 | | 6/2005 | Pergande et al. | |
| 6,921,344 | B2 | | 7/2005 | Gilbert et al. | |
| 6,929,563 | B2 | * | 8/2005 | Nishitani | 473/334 |
| 7,014,571 | B2 | * | 3/2006 | Deshmukh | 473/342 |
| 7,048,648 | B2 | | 5/2006 | Breier et al. | |
| 7,153,219 | B2 | | 12/2006 | Reed et al. | |
| 7,303,486 | B2 | | 12/2007 | Imamoto | |
| 7,481,718 | B2 | | 1/2009 | Soracco | |
| 7,524,250 | B2 | | 4/2009 | Soracco et al. | |
| 7,621,822 | B2 | | 11/2009 | Roach | |
| 7,686,704 | B2 | | 3/2010 | Gilbert et al. | |
| 2002/0042307 | A1 | | 4/2002 | Deshmukh | |
| 2002/0094883 | A1 | | 7/2002 | Chuang | |
| 2002/0107087 | A1 | | 8/2002 | Fagot | |
| 2002/0165041 | A1 | * | 11/2002 | Takeda | 473/334 |
| 2003/0032499 | A1 | | 2/2003 | Wahl et al. | |
| 2003/0045372 | A1 | | 3/2003 | Vrska, Jr. | |
| 2003/0092502 | A1 | | 5/2003 | Pergande et al. | |
| 2003/0125129 | A1 | | 7/2003 | Saksun, Sr. | |
| 2004/0023730 | A1 | | 2/2004 | Nagai et al. | |
| 2004/0116200 | A1 | | 6/2004 | Helmstetter et al. | |
| 2004/0204263 | A1 | | 10/2004 | Fagot et al. | |
| 2005/0096151 | A1 | * | 5/2005 | Hou et al. | 473/335 |
| 2005/0143190 | A1 | * | 6/2005 | Takeda | 473/342 |
| 2005/0277484 | A1 | | 12/2005 | Reed et al. | |
| 2005/0277485 | A1 | * | 12/2005 | Hou et al. | 473/332 |
| 2006/0025234 | A1 | * | 2/2006 | Nicolette et al. | 473/334 |
| 2006/0052184 | A1 | | 3/2006 | Soracco et al. | |
| 2007/0129166 | A1 | | 6/2007 | Shimazaki et al. | |
| 2008/0015051 | A1 | | 1/2008 | Roach et al. | |
| 2008/0051220 | A1 | | 2/2008 | Soracco et al. | |
| 2009/0221382 | A1 | | 9/2009 | Soracco et al. | |

FOREIGN PATENT DOCUMENTS

| | | |
|---|---|---|
| JP | 07-031697 | 2/1995 |
| JP | 07-213656 | 8/1995 |
| JP | 08-024379 | 1/1996 |
| JP | 08-206258 | 8/1996 |
| JP | 08-257181 | 10/1996 |
| JP | 3032837 | 10/1996 |
| JP | 09-173513 | 7/1997 |
| JP | 09-225075 | 9/1997 |
| JP | 11-226158 | 8/1999 |
| JP | 2000-153008 | 6/2000 |
| JP | 2001-161870 | 6/2001 |
| JP | 2003-093550 | 4/2003 |
| JP | 3145482 | 9/2008 |
| WO | WO 2005/082062 | 9/2005 |

OTHER PUBLICATIONS

Japanese Office Action dated Dec. 1, 2008 of corresponding Japanese Patent Application No. 2006-300589.

U. S. Office Action Dated Apr. 18, 2005 in U.S. Appl. No. 10/843,622.

U. S. Office Action Dated Nov. 22, 2005 in U.S. Appl. No. 10/843,622.

U. S. Office Action Dated Jun. 15, 2006 in U.S. Appl. No. 10/843,622.

U. S. Office Action (Final) Dated Feb. 9, 2007 in U.S. Appl. No. 10/843,622.

U. S. Office Action (Advisory Action) Dated May 17, 2007 in U.S. Appl. No. 10/843,622.

U. S. Office Action Dated Aug. 22, 2007 in U.S. Appl. No. 10/843,622.

U. S. Office Action (Final) Dated Feb.,4, 2008 in U.S. Appl. No. 10/843,622.

U. S. Office Action (Notice of Allowance) Dated Oct. 2, 2008 in U.S. Appl. No. 10/843,622.

U. S. Office Action Dated Jul. 18, 2008 in U.S. Appl. No. 10/843,622.

U. S. Office Action Dated Nov. 28, 2007 in U.S. Appl. No. 11/266,172.

U. S. Office Action Dated Jun. 11, 2008 in U.S. Appl. No. 11/266,172.

U. S. Office Action (Notice of Allowance) Dated Dec. 30, 2008 in U.S. Appl. No. 11/266,172.

U. S. Office Action Dated Dec. 12, 2007 in U.S. Appl. No. 11/266,180.

U. S. Office Action Dated Jul. 9, 2008 in U.S. Appl. No. 11/266,180.

U. S. Office Action Dated Sep. 8, 2008 in U.S. Appl. No. 11/266,180.

U. S. Office Action Dated Apr. 14, 2009 in U.S. Appl. No. 11/266,180.

U. S. Office Action, BPAI, *Pre-Brief Conference Decision*, dated Nov. 9, 2009 in U.S. Appl. No. 11/266,180.

U. S. Office Action, BPAI, *Appeal Brief* Dated Dec. 2, 2009 in U.S. Appl. No. 11/266,180.

U. S. Office Action, BPAI, *Supplemental Appeal Brief*, dated Dec. 18, 2009 in U.S. Appl. No. 11/266,180.

U. S. Office Action, BPAI, Advisory Action, dated Jun. 6, 2009 in U.S. Appl. No. 11/266,180.

U. S. Office Action, BPAI, *Amendment (after Final) to Advisory Action*, dated Jul. 14, 2009 in U.S. Appl. No. 11/266,180.

U. S. Office Action, BPAI, *Docketing Notice*, dated Aug. 3, 2010 in U.S. Appl. No. 11/266,180.

U. S. Office Action, BPAI, *Reply Brief Noted*, dated Jul. 16, 2010 in U.S. Appl. No. 11/266,180.

U. S. Office Action, BPAI, *Appellants Reply Brief*, dated May 13, 2010 in U.S. Appl. No. 11/266,180.

U. S. Office Action, BPAI, *Examiner's Answer to Appeal Brief*, dated Mar. 15, 2010 in U.S. Appl. No. 11/266,180.

U.S. Office Action dated Sep. 14, 2009 of corresponding U.S. Appl. No. 11/896,237.

U.S. Office Action dated Mar. 17, 2010 of corresponding U.S. Appl. No. 11/896,237.

U.S. Office Action dated Jul. 30, 2010 of corresponding U.S. Appl. No. 11/896,237.
Japanese Office Action dated Dec. 20, 2010 (mailed Jan. 11, 2011) of corresponding Japanese Patent Application No. 2006-300589 (Trial No. 2009-20956).
U.S. Notice of Allowance dated Jan. 19, 2011 of corresponding U.S. Appl. No. 11/896,237.
U.S. Office Action dated Jan. 25, 2011 in U.S. Appl. No. 12/362,666.

* cited by examiner

MULTI-PIECE GOLF CLUB HEAD WITH IMPROVED INERTIA

CROSS-REFERENCE TO RELATED APPLICATIONS

This application is a continuation-in-part of U.S. patent application Ser. No. 11/808,189, filed Jun. 7, 2007, now U.S. Pat. No. 7,588,503, which is a continuation-in-part of: a) U.S. patent application Ser. No. 11/064,965, filed on Feb. 25, 2005, now U.S. Pat. No. 7,244,188; and, b) U.S. patent application Ser. No. 11/266,180, filed on Nov. 4, 2005, now pending, which is a continuation-in-part of U.S. patent application Ser. No. 10/843,622, filed on May 12, 2004, now U.S. Pat. No. 7,481,718, which are incorporated herein by reference in their entireties.

FIELD OF THE INVENTION

The present invention relates to a golf club head, and, more particularly, the present invention relates to a multi-piece iron-type golf club head with a substantial weight member. The present invention also relates to a golf club head having a top line recess with a light-weight insert.

BACKGROUND OF THE INVENTION

Golf club heads come in many different forms and makes, such as wood- or metal-type, iron-type (including wedge-type club heads), utility- or specialty-type, and putter-type. Each of these styles has a prescribed function and make-up.

Iron-type golf clubs generally include a front or striking face, a top line, and a sole. The front face interfaces with and strikes the golf ball. A plurality of score lines or grooves is provided on the face to assist in imparting spin to the ball. The top line is generally configured to have a particular look to the golfer and to provide weight. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The set generally includes irons that are designated number 3 through number 9, and a pitching wedge. One or more additional long irons, such as those designated number 1 or 2, and wedges, such as a gap wedge, a sand wedge, and a lob wedge, may be optionally included with the set. Each iron has a shaft length that usually decreases through the set as the loft for each club head increases from the long irons to the short irons. The length of the shaft, along with the club head loft, moment of inertia, and center of gravity location, impart various performance characteristics to the ball's launch conditions upon impact and determine the distance the ball will travel. Flight distance generally increases with a decrease in loft angle and an increase in club length. However, difficulty of use also increases with a decrease in loft angle and an increase in club length.

Iron-type golf clubs generally can be divided into three categories: blades, muscle backs, and cavity backs. Blades are traditional clubs with a substantially uniform appearance from the sole to the top line, although there may be some tapering from sole to top line.

Muscle backs have a substantially traditional appearance and are similar to blades, but have extra material on the back. This extra material, which may be in the form of a rib, can be used to lower the club head center of gravity. Having the club head center of gravity lower than the ball center of gravity at contact facilitates the golf shot.

Since blade and muscle back designs have a small sweet spot (that is, the area of the face that results in a desirable golf shot upon striking a golf ball), they are relatively difficult to use and are therefore typically only used by skilled golfers. However, these designs allow the golfer to work the ball and shape the golf shot as desired.

Cavity backs move some of the club mass to the perimeter of the club by providing a hollow or cavity in the back of the club, opposite the striking face. The perimeter weighting created by the cavity increases the club's moment of inertia, which is a measurement of the club's resistance to torque, for example the torque resulting from an off-center hit. This produces a more forgiving club with a larger sweet spot. This also allows the size of the club face to be increased, also resulting in a larger sweet spot. These clubs are easier to hit than blades and muscle backs, and are therefore more readily usable by less-skilled and beginner golfers. Other known golf clubs achieve a desired balance or moment of inertia by adding a weight to the club. These clubs typically add a weight member to the bottom surface of the sole, in the center thereof.

Multi-material cavity backs are the latest attempt by golf club designers to make cavity backs more forgiving and easier to hit. Some of these designs replace certain areas of the club head, such as the striking face or sole, with a second material that can be either heavier or lighter than the first material. These designs can also contain deep undercuts, which stem from the rear cavity, or secondary cavities. By incorporating materials of varying densities or providing cavities and undercuts, mass can be freed up to increase the overall size of the club head, expand the sweet spot, enhance the moment of inertia, and/or optimize the club head center of gravity location. However, due to construction limitations or requirements, some of these designs inadvertently thicken the top portion of the club head. Still, these improvements make the multi-material cavity back design the easiest of all styles to hit, and are ideally suited for the less adroit or novice golfer.

As mentioned above, producing a low center of gravity in a club head increases its playability. One of the ways to lower the center of gravity is to lower the face profile of the head. However, this produces a club head with a bad aesthetic appearance. Another method of reducing the club's center of gravity is to reduce the height of the hosel. However, there are disadvantages to reducing the hosel height, such as: reduced moment of inertia (since hosel mass is far away from the center of gravity), shaft-bonding concerns, and the inability to customize the club head via bending for loft/lie. In addition, many golfers dislike the appearance of a club head that has a very small hosel.

SUMMARY OF THE INVENTION

The present invention relates to a multi-piece iron-type golf club head with a substantial weight member. The golf club head includes a plurality of body members. A first body member includes a face, a rear surface, and a hosel. The rear surface may be curved such that it has a concave profile. A viscoelastic material is attached to the rear surface, and a second body member is attached to the viscoelastic material. The second body member, which may be a weight member, has a substantially larger mass than in known golf clubs. A preferred mass is 10 grams, but it may be as large as 300 grams or more. Characterized differently, the weight member may make up from 4% to 75% of the total club head weight.

The back of the club head includes a recess to bias the club head mass towards the club head perimeter, improving the club head moment of inertia and enlarging the sweet spot.

The multi-piece design of the present invention allows the club designer to separate the structural and non-structural aspects of the club, which allows the designer to independently manipulate and design the structural and cosmetic properties of the head. The design further allows the designer more options in choosing the weighting, inertial, and damping characteristics of the club head, which affect the feel and forgiveness of the golf club. For example, the clubs may be designed such that all of the clubs in the set have substantially the same moment of inertia, helping to create a constant feel throughout the set regardless of the club used.

The present invention also relates to a golf club head having a body defining a front surface, a top line, a sole, a back, a heel, a toe, and a hosel. The top portion of the club head, preferably the top line, contains a recess therein located between the heel and the toe, and extending toward the sole. This recess removes material from the club head, allowing the opportunity to do one or more of the following: increase the size of the overall club head, expand the size of the club head sweet spot, lower the club head center of gravity, and/or produce a greater moment of inertia measured about a vertical or horizontal axis passing through the club head center of gravity. The golf club head of the present invention preferably is an iron-type, a utility-type, or a putter-type golf club head.

An insert formed of a secondary material may be placed within the recess. The insert has a density that is less than the density of the club head body, and the insert preferably is a light-weight insert. This allows the mass removed by the recess to be replaced in more desirous locations on the club head, such as in the perimeter and/or toward the sole. The insert may contain one or more damping materials, such as a viscoelastic material, which have the added benefit of dissipating vibrations that may be created during the golf shot. The incorporation of this secondary material provides improved feel and improved weight distribution, enhancing performance of the club, while still maintaining an aesthetically pleasing overall head shape. The incorporation of this secondary material also improves wearing of the heads over time since the viscoelastic material covers the top-toe area of the club, which is primarily responsible for marks on the head due to club-to-club impacts as the clubs rest in a player's bag.

Instead of a recess, an extension may be provided at the top portion of the club head where relatively high density metallic material has been removed. The insert is attached to the extension.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft angles and others in the following portion of the specification may be read as if prefaced by the word "about" even though the term "about" may not expressly appear with the value, amount or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
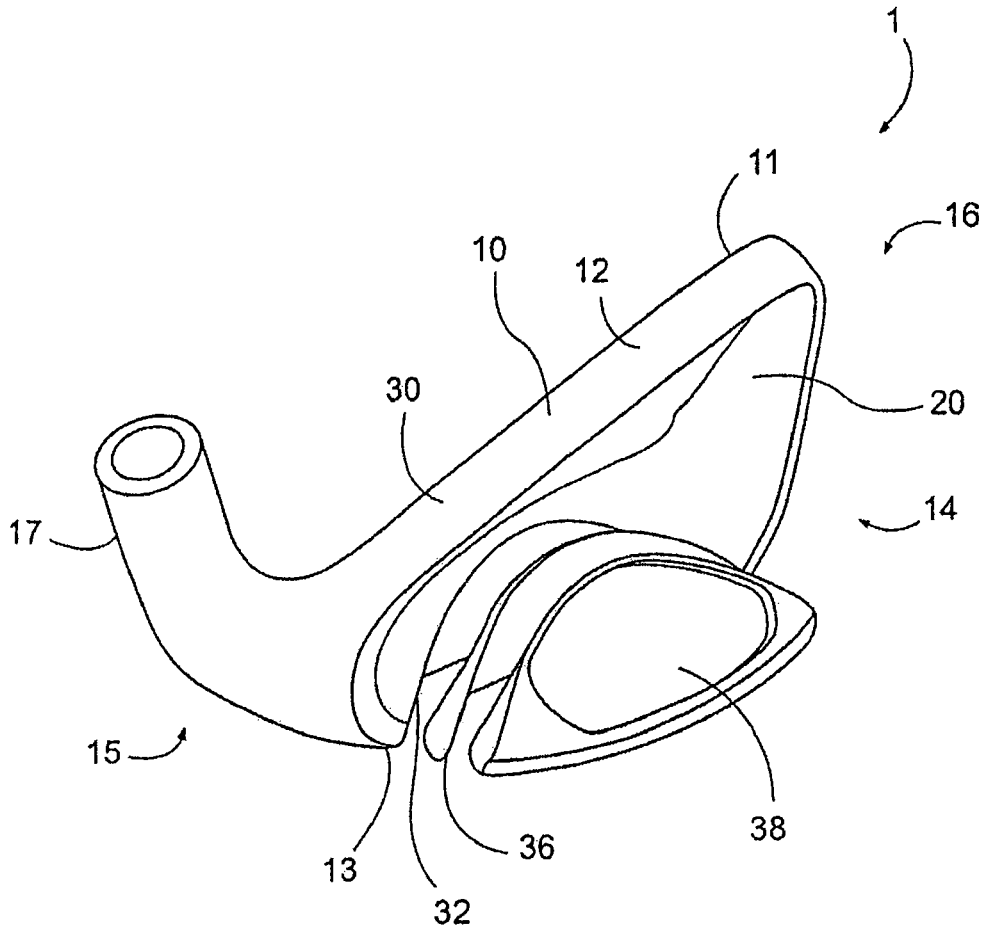
FIG. 1 shows a rear view of a golf club head of the present invention.

FIG. 1 shows the front side of a golf club head 1 of the present invention. The golf club head 1 includes a body 10 defining a front surface 11, a top line 12, a sole 13, a back 14, a heel 15, a toe 16, and a hosel 17. The striking face of the front surface 11, which preferably contains grooves or score lines 18 therein, may be unitary with the body 10, or it may be a separate body, such as an insert, coupled thereto.

The back 14 contains a recess 20 therein, located between the heel 15 and the toe 16. The recess 20 removes material from the club head 1, which inherently provides more of the club head mass towards the perimeter of the club head 1, producing a greater moment of inertia (MOI) measured about a vertical axis passing through the club head center of gravity (with the club grounded in the address position), increasing the size of the club head sweet spot, and lowering the club head center of gravity. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits. Moving or rearranging mass to the club head perimeter enlarges the sweet spot and produces a more forgiving club.

Figure 2:
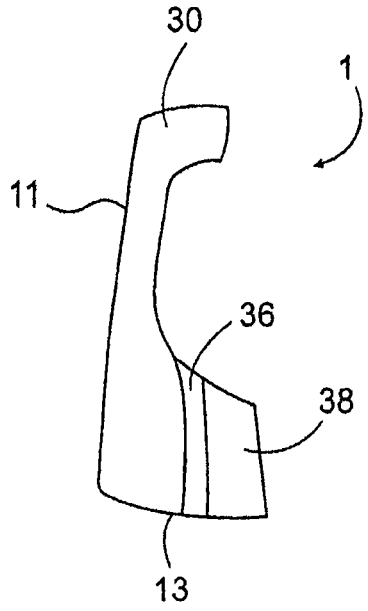
FIG. 2 show cross-sectional views through the club head of FIG. 1.
Figure 3:
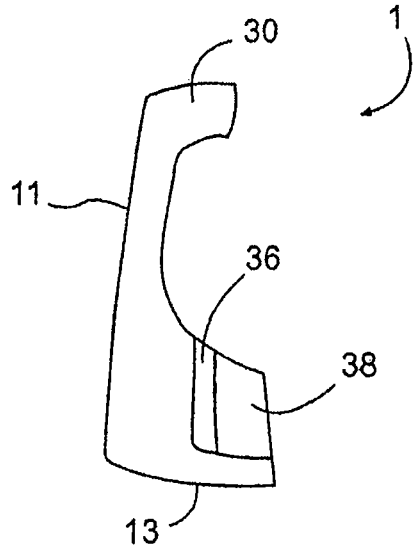
FIG. 3 shows cross-sectional views through an alternate embodiment of the club head of FIG. 1.

The club head 1 is separated into two main pieces. A first body member 30 includes the face 11 and hosel 17, and defines a rear surface 32. A second body member 38 is coupled to the first body member along the surface 32. A viscoelastic material 36, such as urethane or polyurethane, preferably is coupled to the surface 32 intermediate the first and second body members 30, 38. The coupling of the viscoelastic material 36 and the body members 30, 38 may be accomplished in known manner, such as via an adhesive. FIGS. 2 and 3 show cross-sectional views through the club head 1. As shown in FIG. 2, the sole 13 may be comprised of both the first and second body members 30, 38. Alternatively, as shown in FIG. 3, the sole 13 may be comprised solely of the first body member 30.

When designing golf club heads, the designer must be aware of both structural and non-structural concerns and constraints. The designer must position the mass, center of gravity, loft and lies angles, and other structural properties while simultaneously being mindful of the overall appearance and other non-structural properties of the club head. The club head 1 of the present invention comprises two substantial body member pieces 30, 38. By separating the head into a plurality of substantial pieces, the designer is better able to manipulate and design the mass properties of the head 1 as the non-structural material used in the head 1 is independent of the structural/visual components.

Known golf club heads typically employ constrained layer damping, in which a "sandwich" construction of a viscoelastic material and a relatively stiff constraining layer is provided. This design relies solely on the natural properties of the club head components to dampen vibrations generated during use of the golf club. In the present golf club head 1, the first body member 30 is provided with a large cut-out region forming the rear surface 32, which preferably has a concave profile extending from the heel 15 to the toe 16. The second body member 38, which may be referred to as a weight member, preferably has a mass of at least 10 grams. Having a second body member 38 with a substantial mass allows the club head designer to create a mass/spring system to reduce vibrations within the club head 1. Furthermore, it allows the designer to use a greater variety of viscoelastic materials, and get a greater response from the mass/spring system than with previous designs. The weight member 38 preferably may be from 50 to 300 grams, and preferably is at least 100 grams. Characterized differently, the weight member 38 comprises from 4% to 75% of the club head weight, and more preferably from 25% to 50% of the club head weight. The viscoelastic material 36 preferably may be selected from a group of viscoelastic materials, with each of the materials having different functional characteristics. For example, the plurality of viscoelastic materials 36 may be chosen to provide a variety of damping coefficients. Thus, by merely altering the viscoelastic member 36, a variety of clubs with different feels can be provided, allowing golfers a variety of options to tailor the equipment to their specific needs.

Known sets of golf clubs have varying MOI's throughout the set. The size and weight of the club head generally increases through the set with an increase in loft angle. Thus, a pitching wedge is bigger and heavier than a 3-iron. Since MOI is a function of the distance from the club head mass to the center of gravity (or other reference), the MOI of known sets of golf clubs generally increase through the set with an increase in loft angle. The design of the instant club head 1 also advantageously allows the club head designer to maintain substantially constant inertia values throughout the set by selecting a weight member 38 of the appropriate mass. Preferably, the moments of inertia for each club head within the set are substantially equal and have an MOI within the range of 2400 $g \cdot cm^2$ to 2900 $g \cdot cm^2$, with 2500 $g \cdot cm^2$ to 2700 $g \cdot cm^2$ being more preferred. Preferably, the difference between a maximum and a minimum of the moments of inertia is 40 $g \cdot cm^2$ or less. More preferably, this difference is 20 $g \cdot cm^2$ or less. Alternatively, the set may be designed to vary the MOI throughout the set in a desired fashion, such as having lower inertia in the shorter irons. As another alternative, the MOI can be matched to swing speed. Each iron has a shaft length that usually decreases through the set as the loft for each club head increases from the long irons to the short irons. Thus, the swing speed typically decreases through the set from the long irons to the short irons. The design of the instant club head 1 allows the designer to set match the MOI with swing speed, such that MOI increases with a decrease in club speed. As used herein, a set of clubs includes at least three club heads, and more preferably includes at least five club heads, and contains clubs that a golfer would use in a normal round of golf. The set preferably may contain one or more utility-type clubs. Utility-type clubs may be included in place of or in addition to the long irons, such as 3-iron and/or a 4-iron.

Figure 4:
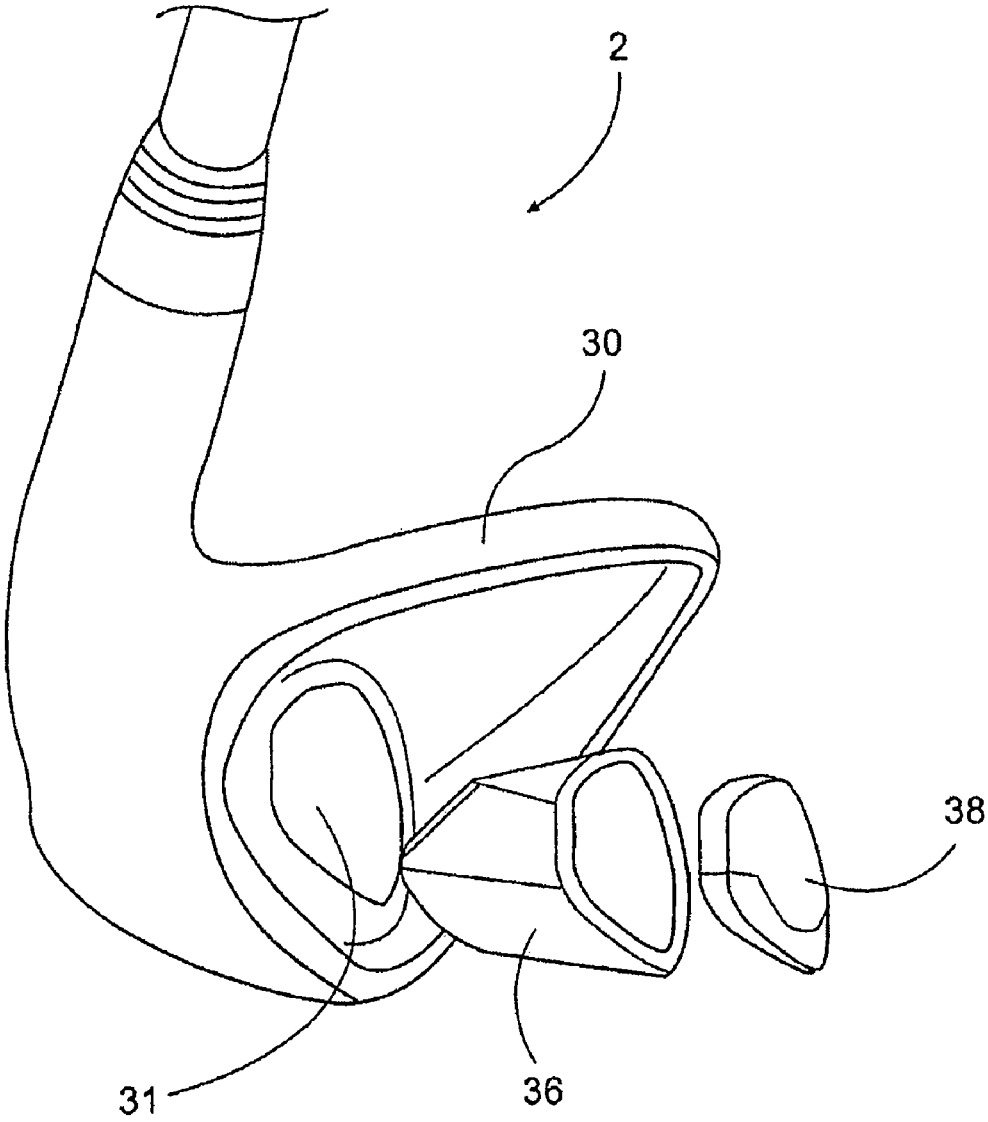
FIG. 4 shows a rear view of a second golf club head of the present invention.

FIG. 4 shows an exploded rear view of a second golf club head 2 of the present invention. This club head 2 has the same general construction as the first club head 1, and provides the same benefits. In this embodiment, the sole is comprised only of the first body member 30, as discussed above in conjunction with FIG. 3. The first body member 30 defines a recess 31, into which the viscoelastic material 36 and the second body member 38 are positioned. As shown in FIG. 4, the layer of viscoelastic material 36 is more substantial than that shown in FIG. 1 with respect to the first golf club head 1. This may preferably allow the same second body member 38 to be used with multiple club heads within a set. A larger amount of viscoelastic material 36 may also allow the club designer to achieve a greater variety of club head characteristics, such as feel, vibration damping, MOI, etc.

Figure 5:
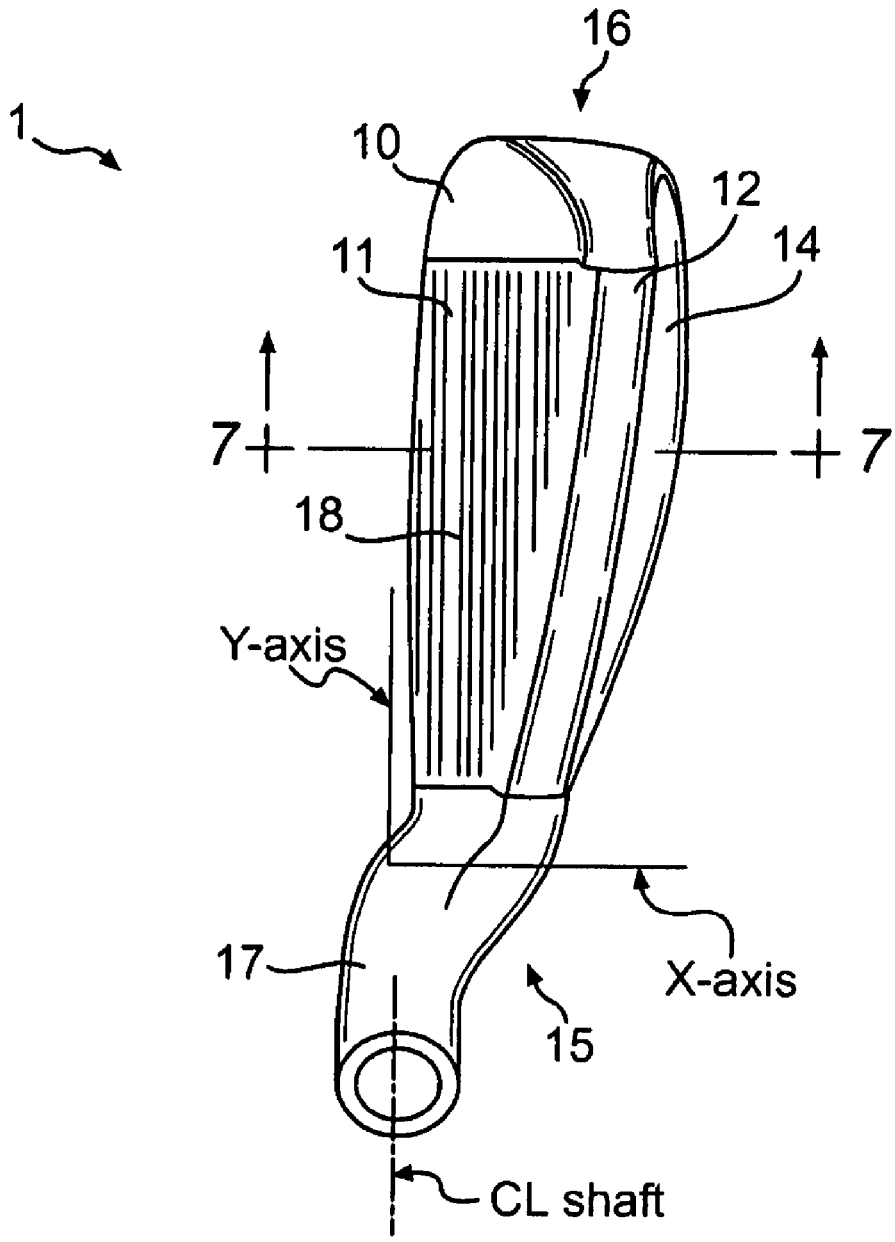
FIG. 5 is a top view of a golf club head of the present invention.
Figure 6:
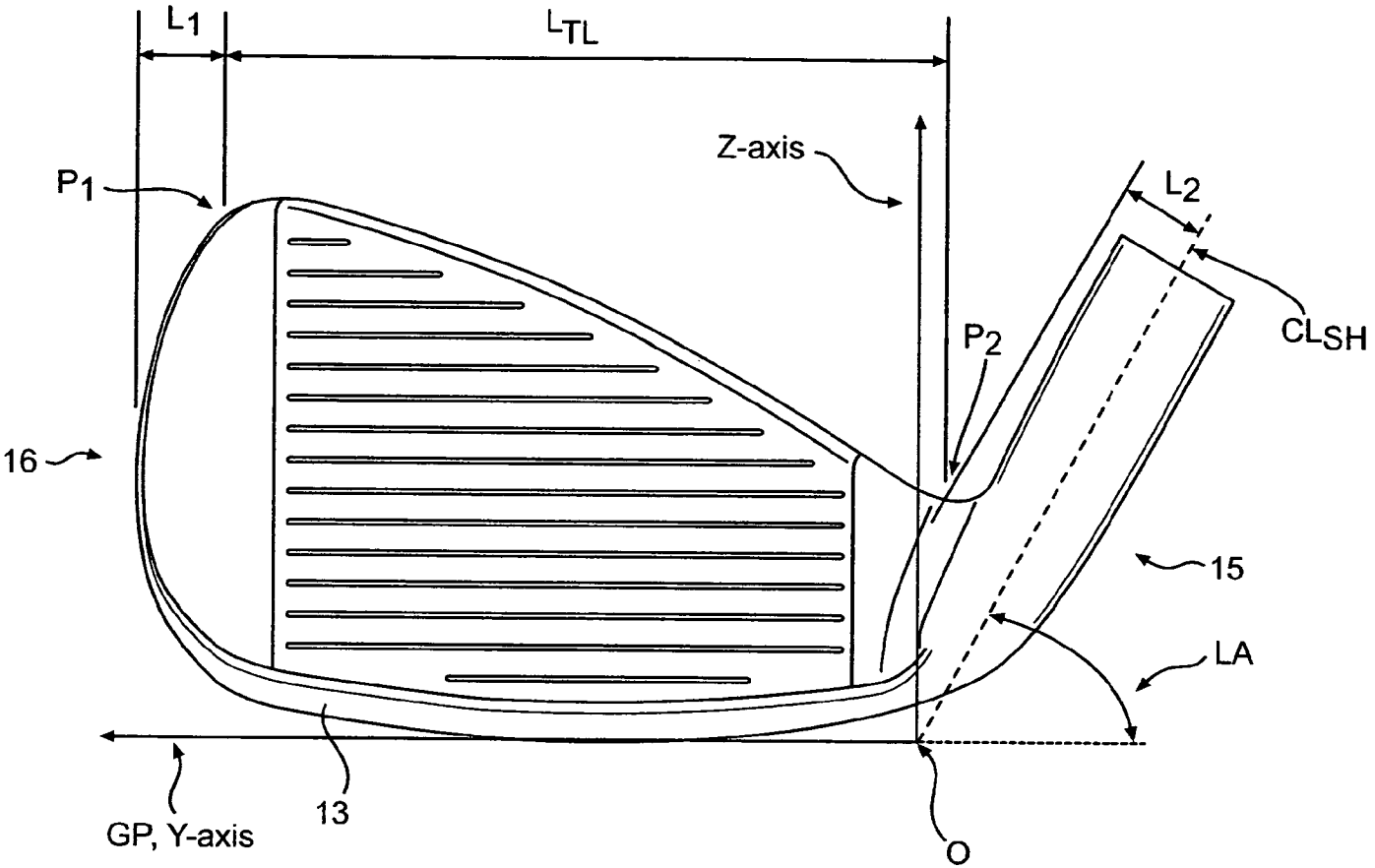
FIG. 6 is a front view of the golf club head of FIG. 5.

FIGS. 5 and 6 define a convenient coordinate system to assist in understanding the orientation of the golf club head 1 and other terms discussed herein. An origin O is located at the intersection of the shaft centerline $CL_{SH}$ and the ground plane GP, which is defined at a predetermined angle from the shaft centerline $CL_{SH}$, referred to as the lie angle LA, and tangent to the sole 13 at its lowest point. An X-axis is defined as a vector that is opposite in direction of the vector that is normal to the face 11 projected onto the ground plane GP. A Y-axis is defined as the vector perpendicular to the X-axis and directed toward the toe 16. A Z-axis is defined as the cross product of the X-axis and the Y-axis.

The top portion of the club head 1 contains a recess 40 therein, located between the heel 15 and the toe 16 and extending toward the sole 13. Preferably, the recess 40 is located in the top line 12 of the club head 1 and extends along the top line 12 from approximately 10% to approximately 95% of the top line length. The top line length $L_{TL}$ is defined as the distance along the top line 12 from a point $P_1$ to a point $P_2$. Point $P_1$ is defined as the intersection of the golf club head 1 and a plane that is offset 0.2 inch ($L_1$) from and parallel to a plane defined by the X-axis and the Z-axis tangent to the toe 16 at the toe's furthest point from the origin O along the Y-axis. Point $P_2$ is defined as the uppermost intersection of the club head 1 and a plane that is parallel to the plane formed by the shaft centerline CLSH and the X-axis offset a distance of 0.3 inch ($L_2$) in a direction closer to the toe 16. The recess 40 removes material from the club head 1, which can be redistributed to other areas of the club head 1 to do one or more of the following: increase the overall size of the club head 1, expand the size of the club head sweet spot, reposition the club head center of gravity, and/or produce a greater MOI measured about either an axis parallel to the Y-axis or Z-axis passing through the club head center of gravity. Moving as much mass as possible to the extreme outermost areas of the club head 1, such as the heel 15, the toe 16, or the sole 13, maximizes the opportunity to enlarge the sweet spot or produce a greater MOI. The recess 40 preferably has a volume of approximately 0.001 $in^3$ to approximately 0.2 $in^3$. In relative terms, the recess 40 preferably has a volume that is from approximately 0.5% to approximately 10% of the volume of the body 10. The recess 40 preferably has a depth D from approximately 0.01 inch to approximately 0.25 inch, which may be a constant depth or a varying depth.

Figure 8:
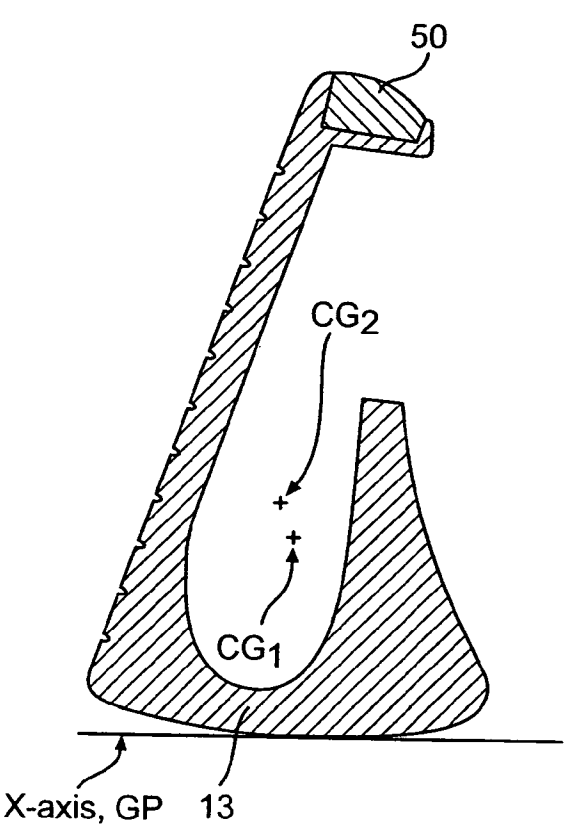
FIG. 8 is a cross-sectional view of the golf club head of FIG. 5, including an insert, taken along lines 7-7.
Figure 9:
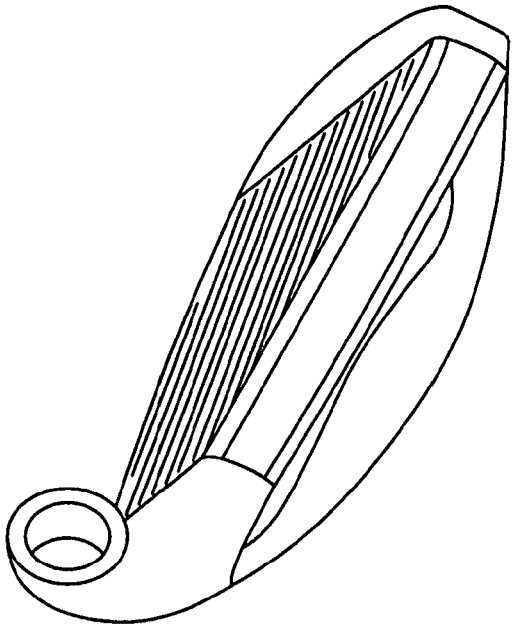
FIG. 9 shows a first isometric view of the golf club head of FIG. 5.
Figure 10:
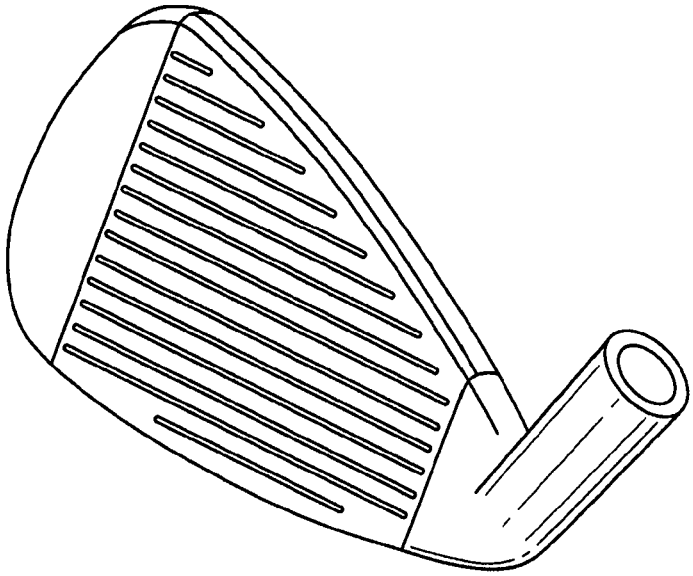
FIG. 10 shows a second isometric view of the golf club head of FIG. 5.

An insert 50 may be positioned within the recess 40. The insert 50, which may be either a preformed insert or cast in place within the recess 40, may be configured to matingly correspond to the recess 40. That is, the insert 50 may be formed and configured to match the contours of the recess 40 and to substantially fill the recess 40. Alternatively, the insert 50 fills only a portion of the recess 40. The insert 50 has a density that is less than the density of the club head body 10. Since the mass of the insert 50 is less than the mass removed by the recess 40, the extra mass may be replaced in more desirous locations on the club head 1. These locations may include, for example, the club head perimeter and/or the sole 13. Alternatively, no additional mass is added to the club head 1; only the recess 40 and the insert 50 are used to enhance the playing characteristics of the golf club. The insert 50 preferably has a density from approximately 0.5 $g/cm^3$ to approximately 5 $g/cm^3$, and is preferably less than the body density by at least 3 $g/cm^3$. The net effect of creating the recess 40 and adding the insert 50 lowers the club head center of gravity ($CG_1$ in FIG. 8) at least 0.01 inch toward the sole 13, as compared to the center of gravity location of a club head without the recess 40 and the insert 50 ($CG_2$ in FIG. 8). That is, the golf club head 1 has a center of gravity located at least 0.01 inch from a center of gravity location for a substantially similar golf club head without the recess 40 and the insert 50. More preferably, the club head center of gravity is lowered at least 0.025 inch toward the sole 13. Additionally, the recess 40 and the insert 50 increase the club head MOI measured about an axis parallel to the Z-axis and passing through the center of gravity by at least 20 $gm \cdot in^2$. That is, the club head 1 has an increase in MOI measured about a vertical axis passing through said center of gravity of at least 20 $gm \cdot in^2$ compared to a substantially similar golf club head without the recess 40 and the insert 50. Thus, the recess 40 and insert 50 produce a more forgiving and playable golf club. FIGS. 9 and 10 show isometric views of the golf club head 1.

The insert 50 may contain one or more damping materials, which diminish vibrations in the club head, including vibrations generated during an off-center hit. Preferred damping materials include those materials known as thermoplastic or thermoset polymers, such as rubber, urethane, polyurethane, butadiene, polybutadiene, silicone, and combinations thereof. Energy is transferred from the club to the ball during impact. Some energy, however, is lost due to vibration of the head caused by the impact. These vibrations produce undesirable sensations in both feel and sound to the user. Because the viscoelastic damping material of the insert 50 is in direct contact with the metal club head (the vibrating body), it serves to damp these vibrations, improving sound and feel. Typical hardness values for the insert 50 may include from 80 Shore A to 50 Shore D. Typical densities for the insert 50 may include from 1.2-2 $g/cm^3$.

Figure 11:
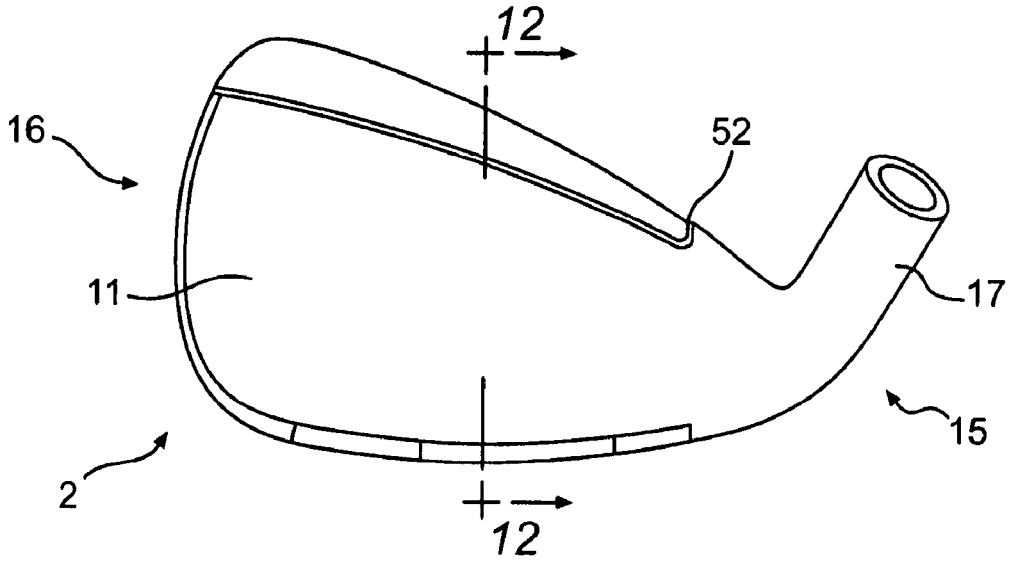
FIG. 11 shows another golf club head of the present invention.
Figure 12:
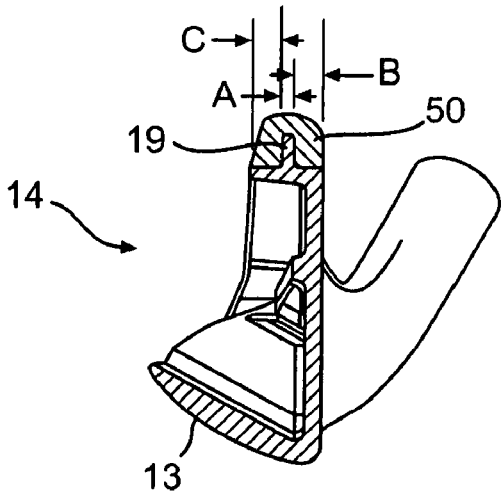
FIG. 12 shows a cross-sectional view of the golf club head of FIG. 11 taken along line 12-12.

FIG. 11 shows another exemplary golf club head 2 of the present invention, and FIG. 12 shows a cross-sectional view of the golf club head 2 taken along line 12-12. In this embodiment, material is removed from the metallic club head at the top line 12. Instead of forming a recess at the top line 12, however, a thin protrusion 19 is provided. Metallic material has been removed from the top portion of the club head as described above, and a thin extension 19 is left in place. The insert 50 has a groove corresponding to the protrusion 19. Thus, the viscoelastic material can be fit onto the club head body 10. The insert 50 is attached to the casting, for example, through the use of an epoxy. A fixture with a cavity that matches the outer perimeter shape of the club head 1 should be used to hold the two pieces in place while the epoxy dries. A preferred width A for the protrusion 19 is 0.06 in., though wider protrusions 19 may be used. This width ensures adequate structural integrity. Preferred heights for the protrusion 19 include 0.06 in. to 0.25 in., though other heights may be used.

It is possible that there are variations in size of the metallic portions of the club heads 1, 2 caused during forming and polishing. These variations typically are larger than the variations in size due to molding viscoelastic materials of the inserts 50. To aid in hiding any discrepancy between the two portions of the club head, a groove 52 may be formed in the insert 50 the edges that are visible to the user once the two pieces have been put together. This groove 52 may be created simultaneously with the rest of the insert 50, or as a secondary step. The preferred width and depth of the groove 52 are 1 mm or less.

In the illustrated example of FIGS. 11 and 12, the protrusion 19 is formed in the center of the top line 12. Alternatively, the protrusion 19 can be formed towards or at the front of the top line 12 or towards or at the rear of the top line 12. The width B of the front portion of the insert 50 may be zero, meaning the protrusion 19 forms the top portion of the face 11. Alternatively, the width B may be, for example, 0.03 to 0.25 in. Similar to the width B, the width C of the rear portion of the insert 50 may be zero, meaning the protrusion 19 forms the top portion of the back 14. Alternatively, the width C may be, for example, 0.03 to 0.25 in. The height of the insert 50, measured along the longest portion thereof, preferably may be from 0.03 to 0.3 in.

A body's center of gravity is determined by its weight distribution. Mass added or removed directly on the center of gravity will have no effect on the center of gravity's location. In contrast, mass added or removed far away from the center of gravity will have the greatest effect on moving the center of gravity. Removing mass from the highest areas of a club head will have the greatest effect on lowering the center of gravity. Adding the mass removed from the high areas to the bottom of the club head will further lower the center of gravity. The top line area and top-of-hosel area are the two highest vertical areas in relation to the ground plane on an iron-type head (when the head is at the address position). By removing the top line portion of the face from the casting and replacing it with a lightweight viscoelastic piece, anywhere from 20-50 grams are removed from the top of the head, depending upon the design of the viscoelastic piece. That weight is redistributed to the bottom portion of the club, lowering the center of gravity even further versus that same club head constructed entirely of a metallic material, such as steel.

MOI is also a property that is affected by mass distribution. Bodies that have mass distributed far from the center of gravity have higher MOI's about their center of gravity than bodies that have mass concentrated near their center of gravity. Removing the mass from the top of the face lowers the MOI about the center of gravity with respect to certain axes. The axis of rotation that relates to an iron's forgiveness is rotation in the heel-toe direction about the center of gravity—an axis parallel to the Z-axis. A higher MOI about this axis indicates greater resistance to twisting on off-center hits and, thus, more forgiveness. By adding the mass removed from the top line 12 back into the low-heel and low-toe areas of the club head, the reduction in MOI in the heel-toe direction due to removal of metallic material from the top line 12 is minimized.

Table 1 shows a comparison of center of gravity locations and MOI's for a 6-iron having a urethane insert 50 as shown in FIGS. 11 and 12 to a similar club head formed completely of steel. Note that the measurements presented in Table 1 do not include any weights that may be added to the club head.

TABLE 1

| | 6-iron with Urethane Top Line | 6-iron with Steel Top Line |
|---|---|---|
| Head mass | 238.3 g | 240.2 g |
| Top Line mass | 4.9 g | 31.1 g |
| Total mass | 243.2 g | 271.3 g |
| $CG_x$ | 1.355 in. | 1.397 in. |
| $CG_y$ | 0.766 in. | 0.862 in. |
| $CG_z$ | −0.478 in. | −0.533 in. |
| $I_{xx}$ | 541 g · cm$^2$ | 740 g · cm$^2$ |
| $I_{yy}$ | 2588 g · cm$^2$ | 2764 g · cm$^2$ |
| $I_{zz}$ | 2832 g · cm$^2$ | 3110 g · cm$^2$ |
| k | 1.173 in. | 1.175 in. |

$CG_x$, $CG_y$, and $CG_z$ are the x-, y-, and z-components of the center of gravity location, respectively.
$I_{xx}$, $I_{yy}$, and $I_{zz}$ are the MOI's about the x-, y-, and z-axes, respectively.
k is the spring constant.

Figure 7:
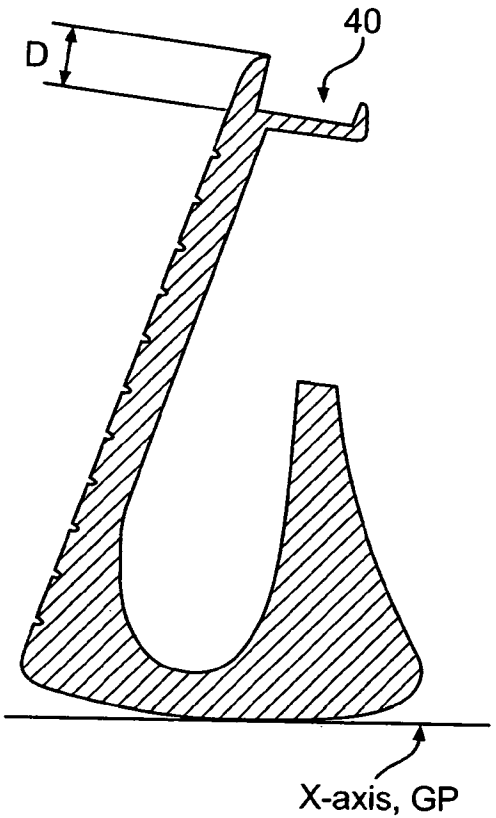
FIG. 7 is a cross-sectional view of the golf club head of FIG. 5 taken along lines 7-7.

Use of the insert 50 pictured in FIGS. 7 and 12 has the added benefit of increasing the durability of the club head 2. Over the course of play, clubs carried together in a bag are knocked together. These impacts create marks on the club heads. The top-toe portion of the club is an area that is likely to impact with other clubs. By making that area out of a softer material, the likelihood of creating marks on the head due to club-to-club impacts is reduced.

Figure 13:
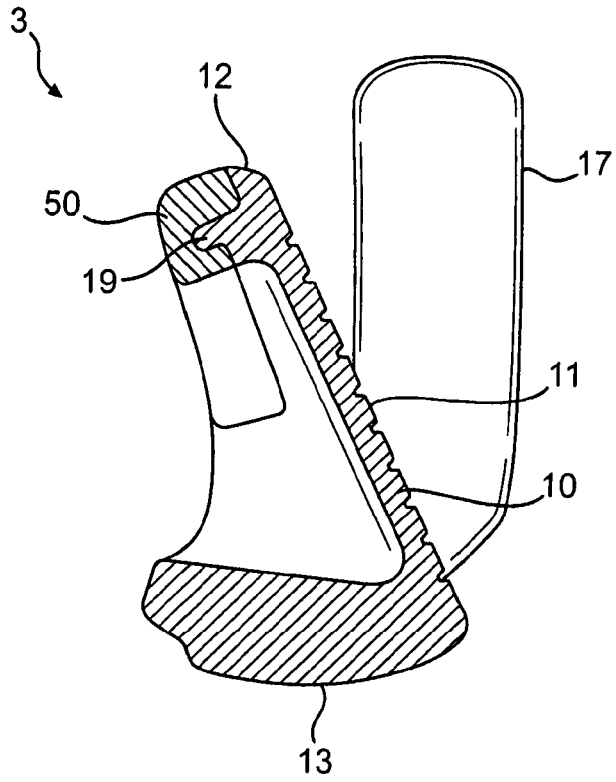
FIG. 13 shows a cross-sectional view of another golf club head of the present invention.

FIG. 13 shows a cross-sectional view of another golf club head 3 of the present invention with the toe portion removed. In this embodiment, metallic material has also been removed from the top line 12 and replaced with a light-weight viscoelastic insert 50. A protrusion 19 is also provided in this club head 3, but unlike the previously discussed club head 2 it is directed backward away from the face 11. The insert 50 contains a groove corresponding to the protrusion 19. Attachment is facilitated through the protrusion 19 and groove. The metallic face material extends to the upper most portion of the face 11 at the top line 12. Alternatively, the viscoelastic material may extend down the top portion of the face 11, for example, up to 0.3 in.

Figure 14:
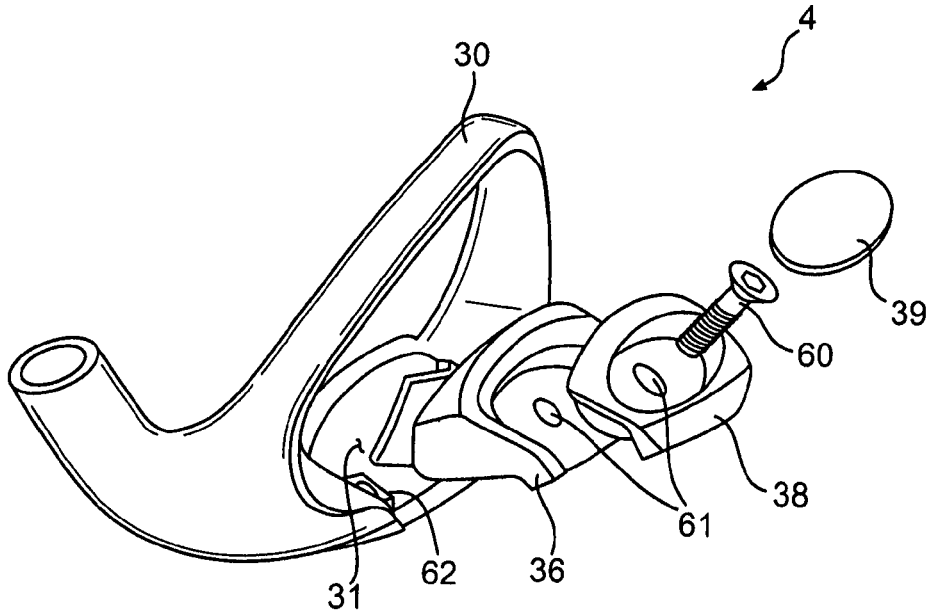
FIG. 14 shows a rear exploded view of a golf club head of the present invention.
Figure 15:
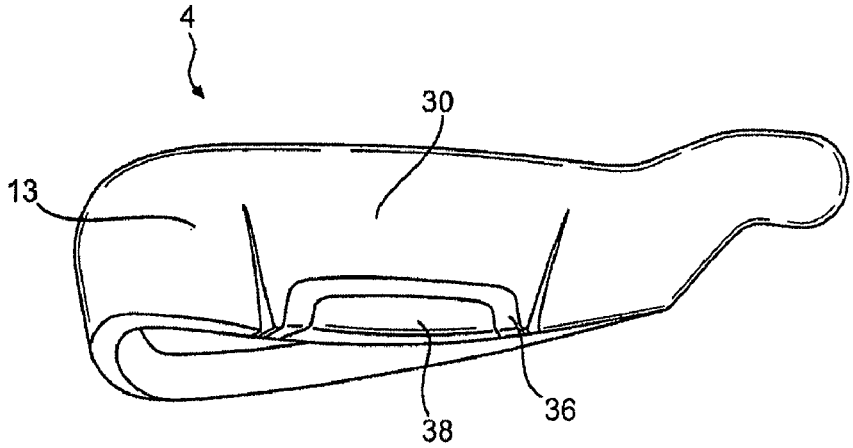
FIG. 15 shows a bottom view of the golf club head of FIG. 14.

FIG. 14 shows a rear exploded view of a golf club head 4 of the present invention. This illustrated club head is similar to the club head illustrated in FIG. 4, and includes a main body 30, here illustrated as a cavity back, defining a recess 31 into which a body of damping material 36 is positioned and retained. The rear portion of the damping member 36 extends downward and rearward past the rearmost edge of the main body member 30. Thus, the damping member 36 forms a portion of the club head sole 13. This lowers the surface of the damping member 36 to which the weight member/second body member 38 is attached, maximizing its effect on positioning (i.e., lowering) the club head center of gravity and enhancing the club head MOI. Thus, the weight member 38 may be positioned such that it forms at least a portion, for example a central portion, of the sole and trailing edge of the club head 4. This is illustrated in FIG. 15, which shows a bottom view of the assembled golf club head 4. It should be noted that the weight member 38 may be homogeneous, such that its density is constant throughout, or it may be selectively weighted, such that its density varies. This varying density may be accomplished in a variety of manners, such as by the inclusion of discrete weight inserts, by forming a unitary entity comprising a plurality of materials having different densities. The density of the weight member 38 may thus be varied such that the density is greater in the heel and/or toe than in the central region thereof.

The coupling of the damping member 36 and the body members 30, 38 may be accomplished in known manner, such as via an adhesive as discussed above. Additionally or alternatively, a mechanical fastener may be used. This is illustrated in FIG. 14, which shows a mechanical fastener 60 that passes through holes 61 in the weight member 38 and the damping member 36 and retained in a receiver 62 in the main body member 30.

A medallion 39 may be included in the present invention. Preferably, the medallion 39 is coupled to and retained within a corresponding recess formed in the weight member 38. If a mechanical fastener 60 is used, the medallion 39 may function as a cover such that the mechanical fastener 60 is not visible, and also such that the mechanical fastener 60 is not alterable once the club head 4 has been fully assembled. The medallion may include indicia thereon, for example to indicate the model of golf club or manufacturer.

As shown most clearly in FIG. 15, the club head of the present invention may have a contoured sole 13. The central portion of the trailing edge is lower than heel and toe portions of the trailing edge. This extension further allows manipulation and lowering of the club head center of gravity and MOI. Additionally, inclusion of a contoured sole reduces turf interaction with the sole during the golf swing.

Figure 16:
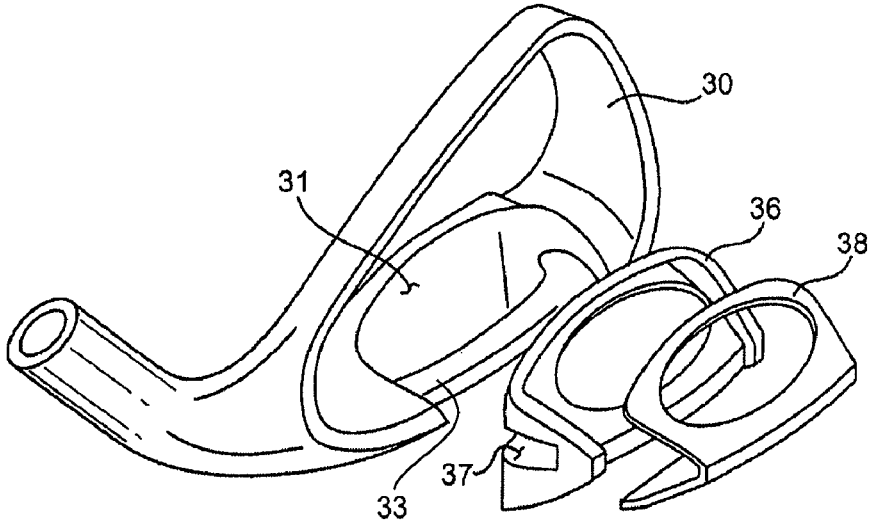
FIG. 16 showing an exploded rear view of a golf club head of the present invention.
Figure 17:
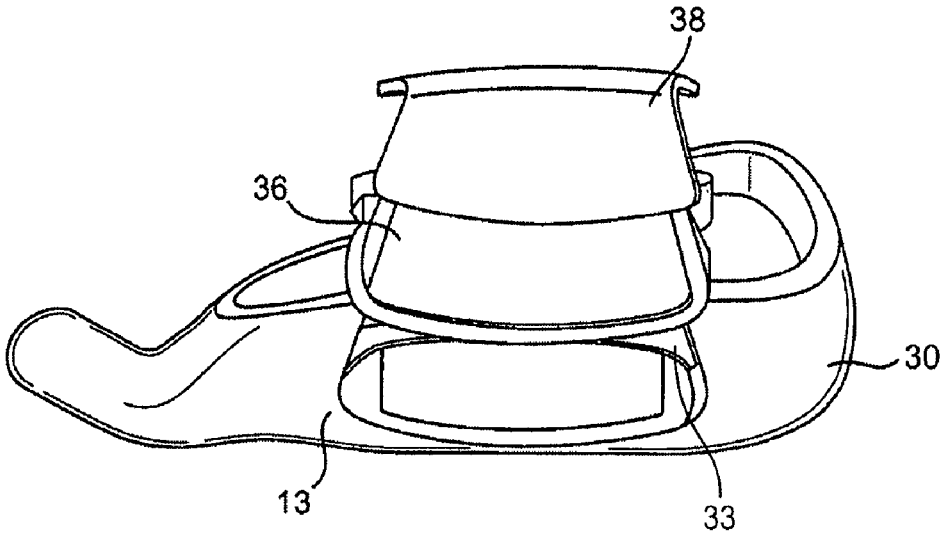
FIG. 17 shows an exploded bottom view of the golf club head of FIG. 17.

FIGS. 16 and 17 show views of another golf club head of the present invention, with FIG. 16 showing an exploded rear view and FIG. 17 showing an exploded bottom view. In this illustrated embodiment, the recess 31 of the main body member 30 is larger than that of the illustrated embodiment of FIGS. 14 and 15. Correspondingly, the damping member 36 is also larger. Additionally, the weight member 38 extends further toward the face. This design removes more mass and weight from the main body member 30, which can be accounted for by increasing the mass and weight of the weight member 38. Extending the bottom portion of the weight member 38 further toward the face 11 increases the percentage of the sole 13 that is comprised of the weight member 38, further lowering the club head center of gravity. Thus, as shown most clearly in FIG. 17, the weight member 38 may form the majority of a central region of the club head sole 13. Additionally, the weight member 38 may extend upward to an extent adjacent the back surface of the club head face 11, preferably in a central region of the back surface of the club head.

To facilitate coupling of the main body 30 and the weight member 36, an attachment arm 33 may be provided. In the illustrated embodiment of FIGS. 16 and 17, the attachment arm 33 takes the form of a bar extending between heel and toe portions of the recess 31. The damping member 36 defines a slit 37 that corresponds to the attachment arm 33 such that, when assembled, the damping member 36 surrounds the attachment arm 33, preferably on at least three sides thereof. The club head components illustrated in FIGS. 16 and 17 can be coupled in known manner, such as via an adhesive and/or a mechanical fastener.

The weight member 38 defines a hole therethrough on the upper portion thereof. This hole removes material from a central portion of the upper region of the weight member 38, biasing the weight thereof toward the club head heel 15 and toe 16. This hole may be covered, such as via a medallion 39. Alternatively, the hole may be left open such that a corresponding portion of the damping member 36 is visibly therethrough. An indicium may be provided on this portion of the damping member 38.

Figure 18:
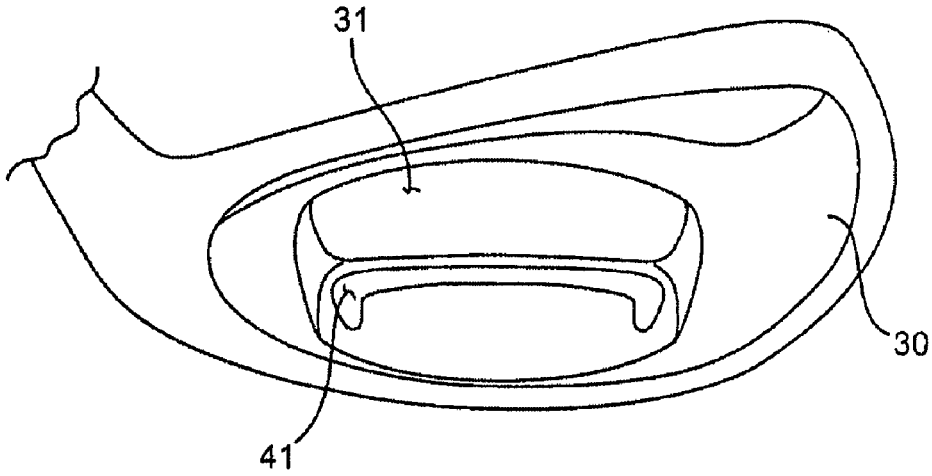
FIG. 18 shows a rear view of a golf club head of the present invention.

FIG. 18 shows a rear view of another golf club head of the present invention. This illustrated club head has a large recess 31 in the main body member 30, similarly to the illustrated embodiments of FIGS. 16 and 17. The corresponding damping member is also large, as previously discussed. In the illustrated embodiment of FIG. 18, however, the main body member 30 forms a majority of the club head sole 13. The main body member 30 defines a slot 41 in a sole portion thereof adjacent the face 11, which inherently biases the weight and club head center of gravity location downward and rearward. The corresponding damping member is positioned and retained in the recess 31 as previously described. A medallion or other back plate may be coupled to the damping member as described above with respect to the illustrated embodiment of FIG. 14.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while the club heads have been illustrated as iron-type golf club heads, the present invention may also pertain to utility-type golf club heads or a putter-type club heads. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. An iron-type golf club head, comprising:

a first body member comprising a striking face, a hosel, a heel, a toe, and an uppermost portion adjacent to the striking face, extending between the hosel and the toe of the club head, defining a top line, a bottommost portion adjacent to the striking face, extending between the hosel and the toe of the club head, defining a sole;

the first body member further comprising a rear surface having a concave profile extending from a heel of the club head to a toe of the club head, wherein the concave profile extends to the sole;

the sole having a sole profile extending between the striking face and the rear surface;

a second body member coupled to the rear surface of the concave profile of the first body member;

a third body member disposed between the first and second body members;

wherein the second body member forms at least a portion of a sole of the golf club head;

wherein the concave profile is oriented in a front to back direction such that the concave profile widens in a continuous curve in a direction substantially parallel to the sole profile.

2. The golf club head of claim 1, wherein the third body member comprises a viscoelastic material.

3. The golf club head of claim 1, wherein the first body member forms at least a portion of a sole of the golf club head.

* * * * *